US008821689B1

(12) United States Patent
Holland et al.

(10) Patent No.: US 8,821,689 B1
(45) Date of Patent: Sep. 2, 2014

(54) STARCH-BIOGUM COMPOSITIONS

(71) Applicants: Daryl Holland, Shorewood, IL (US); Edward P. Pauley, Jesup, IA (US); Joseph S. Squires, Cedar Rapids, IA (US)

(72) Inventors: Daryl Holland, Shorewood, IL (US); Edward P. Pauley, Jesup, IA (US); Joseph S. Squires, Cedar Rapids, IA (US)

(73) Assignee: Penford Products Co., Cedar Rapids, IA (US)

( * ) Notice: Subject to any disclaimer, the term of this patent is extended or adjusted under 35 U.S.C. 154(b) by 0 days.

(21) Appl. No.: 13/952,282

(22) Filed: Jul. 26, 2013

Related U.S. Application Data

(60) Provisional application No. 61/756,979, filed on Jan. 25, 2013.

(51) Int. Cl.

| | |
|---|---|
| ***D21H 17/26*** | (2006.01) |
| ***D21H 17/27*** | (2006.01) |
| ***D21H 17/28*** | (2006.01) |
| ***D21H 17/29*** | (2006.01) |
| ***D21H 17/30*** | (2006.01) |
| ***D21H 17/31*** | (2006.01) |
| ***D21H 17/32*** | (2006.01) |
| ***C08L 1/08*** | (2006.01) |
| ***C08L 5/00*** | (2006.01) |
| ***C08B 37/00*** | (2006.01) |

(52) U.S. Cl.
CPC ..... *D21H 17/31* (2013.01)
USPC ..... 162/178; 162/158; 162/175; 162/177; 162/185; 106/162.1; 106/205.4; 106/206.1; 106/217.4; 536/56; 536/84; 536/102; 536/114; 525/50; 127/32

(58) Field of Classification Search
USPC ..... 162/158, 170, 175–178, 183, 185, 162/181.1–181.8; 536/1.11, 3, 56, 84, 536/123.1, 102, 114; 127/29, 32, 34, 127/65–71; 106/162.1, 162.8, 162.81, 106/163.01, 165.01, 170.57, 172.1, 178.1
See application file for complete search history.

(56) References Cited

U.S. PATENT DOCUMENTS

| | | | | |
|---|---|---|---|---|
| 2,949,397 | A | 8/1960 | Werner et al. | |
| 4,014,743 | A | 3/1977 | Black | |
| 4,105,461 | A * | 8/1978 | Racciato | 106/205.01 |
| 4,710,270 | A | 12/1987 | Sunden et al. | |
| 4,869,916 | A * | 9/1989 | Clark et al. | 426/573 |
| 5,079,348 | A | 1/1992 | Clare et al. | |
| 5,080,717 | A * | 1/1992 | Young | 106/140.1 |
| 5,104,487 | A | 4/1992 | Taggart et al. | |
| 5,112,445 | A | 5/1992 | Winston, Jr. et al. | |
| 5,458,679 | A | 10/1995 | Fairchild | |
| 5,536,764 | A | 7/1996 | Nguyen et al. | |
| 5,800,870 | A | 9/1998 | Luebke et al. | |
| 5,891,305 | A * | 4/1999 | Dondeyne et al. | 162/175 |
| 5,942,087 | A | 8/1999 | Pruszynski | |
| 6,165,321 | A | 12/2000 | Pauley et al. | |
| 6,290,814 | B1 | 9/2001 | Rooff et al. | |
| 6,677,386 | B1 | 1/2004 | Giezen et al. | |
| 6,755,915 | B1 | 6/2004 | Van Soest et al. | |
| 7,625,962 | B2 | 12/2009 | Laleg | |
| 7,892,613 | B2 | 2/2011 | Meazle et al. | |
| 8,088,251 | B2 * | 1/2012 | Buwono et al. | 162/164.2 |
| 2009/0142812 | A1 | 6/2009 | Skuratowicz et al. | |
| 2012/0115964 | A1 * | 5/2012 | Foster et al. | 514/777 |

* cited by examiner

*Primary Examiner* — Dennis Cordray
(74) *Attorney, Agent, or Firm* — Marshall, Gerstein & Borun LLP

(57) ABSTRACT

A composition comprising starch, a biogum and water subjected to heat, shearing and optionally depolymerization is provided which is useful as a stable high solids dispersion useful in various applications including as wet-end additives for paper making.

24 Claims, 3 Drawing Sheets

STARCH-BIOGUM COMPOSITIONS

CROSS-REFERENCE TO RELATED APPLICATIONS

This application claims priority benefit of U.S. Provisional Application No. 61/756,979 filed Jan. 25, 2013 the disclosure of which is incorporated herein by reference.

BACKGROUND OF THE INVENTION

The invention relates generally to compositions comprising starch and biogums and more specifically to stable high solids starch/biogum compositions which are readily pumpable and flowable and characterized by stable viscosity. In particular, the invention relates to highly stable compositions comprising depolymerized starch and gellan gum.

The invention also relates to compositions for paper manufacturing including additives for the wet-end of a paper manufacturing process as well as for other aspects of paper and paperboard manufacture.

Starch is the most widely used additive in the paper industry. It is mainly used in paper to provide dry strength to the final paper or board product. It is used in three primary areas of the paper making process; the size press which uses about 65% of the total starch, the wet-end which uses about 20% of the total starch and as a coating binder which uses about 15% of the total starch used in the paper making process.

There are notable differences in the starches used in the three areas. The wet-end uses the highest molecular weight starch (usually native molecular weight, i.e. not thinned), and the wet-end starches are almost exclusively cationic starches. Size press starches are always reduced in molecular weight to allow them to be run at higher solids and lower viscosity. They may be cationic in nature but are normally enzyme or persulfate converted, oxidized or hydroxyl ethylated starches. Coating starches are usually further reduced in molecular weight and again (with few exceptions) are not cationic. Like size press starches, they are normally oxidized or hydroxyl ethylated, with some enzyme converted or persulfate converted starches being used.

Although a significant amount of the total starch used in paper and board manufacture is added to the wet-end of the paper or board machine, it is still much less than that used at the size press. This is in spite of the fact that starch added in the wet-end is much more efficient at increasing the strength of the paper or board (particularly heavy weight papers and board). Starch is more efficient in the wet-end because it is more evenly distributed throughout the sheet whereas starch applied at a size press starch has difficulty penetrating to the center of the sheet. In addition, since the size press starches are lower molecular weight, they do not add strength as efficiently as the higher molecular weight wet-end starches. Finally, the single biggest reason that the wet-end is better than the size press for adding starch is that the sheet is rewetted in the size press and must be re-dried after going through the size press. This means that the paper machine must have additional dryer capacity and there is an energy cost to this additional drying.

The reason for the high molecular weight of wet-end starches is that strength development is thought to occur by a bridging of the wood fibers by the starch molecules. Since the starch molecules are placed in a very dilute environment with the wood fibers, higher molecular weight starches are thought to be better retained and exhibit higher activity (better bonding) than lower molecular weight starch molecules. This has shown to be the case in conventional wet-end systems when comparing a cationic potato starch (which has higher average molecular weight) to a cationic dent corn starch. On a dry lb/ton comparison basis, the potato starch will generally outperform the corn starch. The reason potato starch is not more commonly used in the paper industry is more economical (cost per pound) than performance.

The limiting factor in the use of conventional wet-end cationic starches is a tendency to reduce drainage and retention at high dosages. For high charge cationic starches (which can work very well, especially in dirty, recycled furnishes) the creation of foam at high dosages limits their use. There is a need, therefore, for a starch material that gives high strength, improves (or does not interfere with) drainage and retention and can be used at higher dosages for difficult higher weight papers and boards, particularly in recycled fiber furnishes.

There are many other chemicals used in the wet-end of the paper machine. These would include (but are not limited to): wet strength resins (cationic polyamide-epichlorohydrin resins), polyacrylamide dry strength resins, polyacrylamide-polyacrylic acid anionic resins, ASA and AKD sizing compounds, colloidal silica, $CaCO_3$ fillers ($TiO_2$, clay, silica), CMC, retention aids, and in certain cases alum and rosin sizing (used mostly in non alkaline papermaking systems). All of these materials interact with each other and with the fiber and (in the case of recycled papers and paperboard) other substances (contaminants) that comes along with the recycled fiber. Any new material added to a paper making system (especially if the new material is added to a recycled fiber system) must have a positive interaction with most if not all of the substances and chemicals listed above.

Combinations of starches and biogums are well known in the art of paper manufacturing. For example, Winston, Jr. et al., U.S. Pat. No. 5,112,445 reports that a combination of gellan gum and starch demonstrates enhanced film formation on the surface of a coated paper sheet. The compositions disclosed by Winston, Jr. comprise a hydroxyethyl starch ether in combination with a low-acyl gellan gum at weight ratios ranging from 80:1 to 160:1. Winston, Jr. does not teach starch/gellan gum ratios that enhance internal strength nor that affect size pickup levels. Nevertheless, there remains a desire in the art for improved surface sizing compositions providing improved properties.

Rooff et al., U.S. Pat. No. 6,290,814, the disclosure of which is hereby incorporated by reference, discloses a method for sizing paper which comprises the step of coating paper with a composition comprising gellan gum and a derivatized starch wherein the derivatized starch and the gellan gum are present at a weight ratio of from 300:1 to 1000:1. Also provided by the invention are improved papers adapted for ink jet printing characterized by an ash content of from 5% to 30% by weight, permeability characterized by a Hercules Size Test (HST) score in the range of over 200 seconds and treated with a surface size comprising gellan gum and a derivatized starch wherein the derivatized starch and the gellan gum are present at a weight ratio of from 100:1 to 1000.

Werner et al., U.S. Pat. No. 2,949,397 discloses incorporating loading agents or fillers, together with an organic colloid material (locust bean gum, guar gum, konjak) into paper in such a way that the particles of filler are wholly or partly coated with the organic colloid material. As stated in the patent, the particles of mineral filler do not form stable suspensions with the colloidal dispersions of the (locust bean gum, guar gum, konjak or substituted versions thereof) and must be kept agitated.

Sundén et al., U.S. Pat. No. 4,710,270 describes a process for combining a "swollen" cationic starch with a polysaccharide acid of high charge density such as CMC and alginates.

The cationic starch and CMC or alginate is then mixed with a polyaluminum citrate complex and blended with clay or chalk to form an envelope around the clay or chalk. These amphoteric mucous compounds are then mixed with the filler slurry and added to the wet-end of a paper machine. While these amphoteric mucous compounds do show improved retention and strength, they are not practical to make at a commercial level since they are low solids, unstable mixtures.

Clare et al., U.S. Pat. No. 5,079,348 describes a combination of starch, a biogum and an alginate for use on the size press of a paper machine. Again, the mixtures are low solids (8-10%) and are made to be used at a temperature of 100-160° F. Taggart et al., U.S. Pat. No. 5,104,487 describes a process for adding a cationic starch and a biogum to the cellulosic fibers in a normal paper machine furnish, Taggart teaches that the starch and biogum must be added separately to the furnish to achieve uniform distribution and maximum strength. Taggart also teaches use of relatively high levels of gum relative to the weight of cationic starch.

Fairchild, U.S. Pat. No. 5,458,679 teaches treating inorganic materials such as calcium carbonate, clay, $TiO_2$, talc and the like with an anionic polysaccharide such as anionic guar or xanthan gum. The anionic polysaccharide is mixed with the inorganic material prior to addition to the cellulosic fibers in the pulp slurry. They do not teach making a stable, high solids blend with these materials. Nor do they teach that any of these blends will have an effect on the retention and drainage of the furnish when used on a paper machine.

As seen by the prior patents, a need exists for a high solids, stable, pumpable/flowable combination of biogum and starch that is cost effective and ready to use in the wet-end of a paper machine and not only provides strength, but also improves drainage and retention.

Of interest to the present invention is the disclosure of Black, U.S. Pat. No. 4,014,743 which discloses a method for continuous enzyme liquefaction (thinning) of starch to produce high solids dispersions of cooked starch and water. The process consists of (a) mixing a granular starch with water; (b) adding an enzyme (usually a bacterial alpha-amylase) to the composition; (c) adding the composition of step (b) to a stirred and heated tank on a continuous basis such that the peak cook viscosity in the stirred tank of the cooked and thinned paste is lower than would be possible if the entire mixture of (b) was heated and cooked as one batch. The cooked and thinned paste of (c) is then passed (after a certain start-up period) through a jet cooker to deactivate the enzyme and finish dispersing the starch molecules. This cook process allows higher solids of the cooked paste due to the fact that the maximum viscosity of the cooked paste at any point in the cook process (even at much higher solids) is much lower than would seen if the entire batch was cooked at once.

Also of interest to the present invention is the disclosure of Skuratowicz et al. U.S. 2009/0142812 which is directed to methods of making high molecular weight reduced viscosity starch pastes by (a) mixing a granular starch with water; (b) adding one or more starch hydrolyzing enzymes to the composition; (c) jet cooking the composition of step (b) in a first jet-cooker to a temperature of from 160° F. to 210° F.; (maintain the composition for a specified hold time; (e) following step (d) jet-cooking the composition in a second jet-cooker to a temperature to a temperature from about 250° F. to 300° F. and recovering a hydrolyzed starch paste wherein at least 20% of the polymers in the paste have a molecular weight from 10,000 to 200,000 Daltons and fewer than 5% of the polymers have a molecular weight less than 10,000 Daltons.

Also of interest to the invention is the use of biological gums such as guar in applications such as in water treatment for example in the manufacture of flocculants and as "muds" for oil drilling and as proppants and hydraulic fracturing fluids the increased use of which has resulted in shortages and significant price increases for gums such as guar.

Accordingly, there remains a need for compositions to provide improved physical properties to paper and paperboard as well as for other uses.

BRIEF SUMMARY OF THE INVENTION

The present invention relates to stable aqueous carbohydrate compositions comprising starches and methods for their production. The invention further provides products comprising such compositions for use in the manufacture and treatment of paper and other products, methods for their use and improved paper and paperboard products. More specifically, the invention provides methods of preparing depolymerized starch compositions for use in a variety of end-uses whereby the starches are subjected to acid or enzyme thinning prior to, during and/or after being subjected to heating and shearing in the presence of a biogum such as gellan. The resulting products are characterized by improved stability at high solids levels and provides improved properties when incorporated with other organic and inorganic materials including organic materials such as starches and cellulose and inorganic materials such as minerals including silica, alumina, calcium carbonate, clay and the like.

In particular, the resulting products are useful in papermaking and paper coating applications such as at the wet-end of paper manufacturing and as components of paper coatings for coated paper and boards. The resulting products are also useful for board lamination and for spraying between the plies on a multi-ply paper board machine as well as for tissue and towel manufacture.

The present invention provides compositions and methods for the production of such compositions comprising a starch, a biogum and water subjected to heat and shearing sufficient to hydrate and disperse the starch and biogum molecules to produce a pumpable/flowable viscosity stable dispersion having a Brookfield viscosity of less than 20,000 cps (as measured on a Brookfield RVT at 75° F., #5 spindle, 10 rpm) and a solids 15% solids dry substance (ds) basis. The invention is particularly useful in providing stable starch biogum compositions having elevated solids levels including those with solids levels of greater than or equal to 20% (ds); greater than or equal to 30% (ds); greater than or equal to 40% (ds); greater than or equal to 50% (ds); and even greater than or equal to 60% (ds).

The starch biogum compositions are pumpable and flowable while maintaining their stability at high solids levels and preferably have viscosities of less than or equal to 12,000 cps (as measured on a Brookfield RVT at 75° F., #5 spindle, 10 rpm) or even less than or equal to 10,000 cps (as measured on a Brookfield RVT at 75° F., #5 spindle, 10 rpm)

While those of skill in the art would be able to determine the suitable biogum levels for practice of the invention it is contemplated that biogums may be incorporated at levels ranging from as little as 0.1% up to as high as 4% of as is biogum to ds starch (or starch plus resin) although concentrations higher than 4% tend to become too highly viscous to be workable. Thus concentrations ranging from 0.1 to 2.5% of as is biogum to ds starch (or starch plus resin) are generally more preferred.

Biogums suitable for use according to the invention include those selected from the group consisting of gellan, xanthan gum, locust bean gum, carrageenan, guar, alginate, carboxymethylcellulose (CMC), hydroxyethylcellulose (HEC), hemicellulose, gum Arabic and agar. Particularly preferred biogums for practice of the invention are those characterized by a charge and thus include gellan gum, xanthan gum, alginates, guar, CMC and carrageenan with gellan and alginates being particularly preferred for use according to the invention.

The compositions may optionally comprise more than one biogum but it is generally preferred that one of the biogums be selected from the group consisting of gellan, xanthan, alginates, carrageenan and guar with it being particularly preferred that at least half of the biogum content (by weight) be gellan. According to one aspect of the invention the additional biogum is alginate or xanthan It is contemplated that starch from virtually any plant species may be used in practice of the invention with particularly preferred starches being those selected from the group consisting of dent and waxy corn starch, potato, rice tapioca, pea, and sorghum with waxy corn starch and potato starches being particularly preferred. The starches can be pregelatinized or can be un-pregelatinized known as "cook-up" starches.

It is also contemplated that the starches used according to the invention may be modified and/or derivatized in any of various manners known to the art. Useful starches include those wherein the starch is a derivatized starch selected from the group consisting of cationic starches, anionic starches, amphoteric starches, etherified starches, acetylated starches and sulfonated starches. A particularly preferred starch is that wherein the starch is a cationic waxy corn starch. Another preferred starch is that wherein the starch is an anionic waxy corn starch.

According to one aspect of the invention derivatized starches are preferred with OSA modified waxy corn starch being particularly preferred according to one aspect of the invention.

According to a preferred aspect of the invention the starches are depolymerized (thinned) by any of a variety of means known to those of ordinary skill in the art including enzyme thinning, acid thinning, oxidative thinning and the like. According to one embodiment the starch is at least partially depolymerized prior to being subjected to heating and shearing. The starch can also be subjected to depolymerization after being subjected to heating and shearing but according to a particularly preferred aspect of the invention is depolymerized, at least in part, by enzymatic thinning during the heating and shearing process such as it carried out in a jet cooker. According to a particularly preferred aspect of the invention the enzyme thinning takes place in the presence of an alpha amylase with the use of thermophilic alpha amylases being particularly preferred because such thermally stable alpha amylases may be used during the heating and shearing treatment such as within stirred tank and jet cooking apparatus.

According to one aspect of the invention the mixture is held at a temperature of at least 140° F. and is more preferably held at a temperature of at least 165° F. Those of ordinary skill would be able to empirically determine combinations of time and temperature useful according to the invention but it is particularly preferred that the starch/gum composition be held at a temperature of at least 165° F. for from 5 to 30 minutes.

The alpha amylase may be inactivated by the application of a substance such as sodium hypochlorite which will inactivate the enzyme or by treatment at an elevated temperature sufficient to inactive the enzyme.

According to another aspect of the invention the starch is made by acid hydrolysis of the starch in the granular state prior to the heating and shearing process. Alternatively, the starch is made by oxidation of the starch in the granular state prior to the heating and shearing process. According to another aspect of the invention the starch is a pregelled starch prior to being subjected to heating and shearing.

The starch biogum compositions of the invention may be used in a variety of applications in the paper industry and elsewhere. The compositions are particularly useful in the production of wet-end paper making additives for use in paper manufacture wherein the starch subjected to heating and shearing is a first cationic starch and wherein the composition is further combined with a second cationic starch such as is used in conventional wet-end additives. According to a preferred aspect of the invention the second cationic starch is a high charge, liquid cationic starch. According, to an alternative aspect of the invention, a wet-end paper making additive is provided wherein the second cationic starch is a low charge liquid cationic starch.

According to another aspect of the invention the wet-end paper making additive is provided wherein the starch subjected to heating and shearing is a first anionic starch and the composition further comprises an anionic resin. The wet-end additives of the present invention can also further comprise an uncooked starch. Such uncooked starches are then capable of "cooking out" by the application of heat during the paper manufacturing process. Such uncooked starches can include any of a variety of starches known to be useful by those of ordinary skill but are preferably selected from the group consisting of dent and waxy corn, potato, rice, tapioca, pea, and sorghum starches. Particularly preferred uncooked starches for incorporation into the wet-end additives of the invention include those in which the starch is an unmodified dent corn starch, an unmodified waxy corn starch or an unmodified potato starch.

According to a further aspect of the invention the wet-end paper making additive comprises a modified starch as the uncooked starch with a particularly preferred modified starch being cationic starch. In addition, modified starches can include etherified starches including but not limited to hydroxyethyl starch and hydroxypropyl starch. The modified starches of the invention may be selected from the group consisting of dent and waxy corn, potato, rice, tapioca, pea, and sorghum.

The wet-end paper making additives can further comprise a filler. Such filler can include organic and inorganic fillers with preferred inorganic fillers including those selected from the group consisting of calcium carbonate, clay, titanium dioxide, talc, silica, alumina, colloidal silica and similar materials.

The starch/biogum compositions of the invention may be used as paperboard additives for application between the plies of a paperboard.

The compositions of the present invention may be used in various aspects of paper manufacture particularly in three primary areas of the paper making process; the size press which uses about 65% of the total starch, the wet-end which uses about 20% of the total starch and as a coating binder which uses about 15% of the total starch used in the paper making process.

It is believed that there is a particularly positive (and beneficial) interaction of the products of the present invention and the colloidal silica commonly used in the pulp slurries of recycle paper and paperboard machines. While not wishing to be bound by any particular theory, it is believed that the cooked starch and biogum (particularly cationic starch) have an unusually positive interaction with the negatively charged colloidal silica particles which improves drainage and retention (and thus lowers drying cost and increases machine speed). According to one preferred aspect of the invention, colloidal silica is administered at a concentration of 0.1 to 4 lbs dry substance per ton of dry substance pulp fiber.

It is particularly surprising that the compositions of the present invention (when added to the fiber slurry in the wet-end of a paper or board machine) not only increase strength (as measured by stiffness, burst, ring crush, tensile, etc.) and plybond (as measured by Scott Bond, ZDT, BRDA, etc.) they also improve (sometimes dramatically) drainage and retention. The products of the current invention improve drainage and retention while at the same time they have a reduced tendency to create foam and overcharge the system. The products of the present invention work particularly well in recycle fiber systems that contain large amounts of anionic trash, including recycled materials with large amounts of wet strength resins. Because the products of the present invention work so well in dirty systems without causing foaming or negatively impacting drainage and retention, more of these materials can be used than conventional wet-end starches, allowing the use of more starch in the wet-end, and thereby further improving their usefulness to the papermaker.

Wet end starches are used at various levels in the wet-end of the paper or board machine mostly depending on the type of paper or board being produced. For example, a board machine producing board with a high content of recycled fiber will use more starch at a higher cationic charge than a board (or paper) machine using virgin fiber. The starch dosage added to the paper or board machine is measured in dry pounds of starch to dry tons of fiber used to product the paper or board. Starch usage in paper or board manufacture can vary from as low as 0.5 to 2 lbs of ds starch per ton of fiber up to (and sometimes exceeding) 40 lbs starch per ton of fiber. Very light weight sheets such as tissue and towel will use less starch and at a lower cationic charge due to the relatively low cationic demand of the fiber (clean virgin fiber is much less anionic than recycled fiber). Therefore, to add more starch to these systems, either the total cationic charge of the wet end starch must be reduced or an anionic starch (or polymer) must be added to offset the cationic charge which allows more total starch to be added and also keep the total system charge neutral or slightly anionic (paper or board machine wet end pulp slurries need to be neutral or slightly anionic for the paper or board machine to perform at optimal efficiency).

The products of the current invention are particularly useful in that they can be used at higher dosages (lbs of ds starch to tons of fiber) without overcharging the wet end (making the overall charge of the pulp slurry cationic) of the paper machine. At the same time, the products of the current invention give higher strength at lower dosages than high performance starches currently being used.

It has been discovered that subjecting an aqueous starch and biogum composition to heat and shearing under selected conditions such as jet cooking is capable of producing a viscosity stable, high solids pumpable/flowable dispersion comprising a starch and biogum. According to one preferred aspect of the invention, an aqueous starch and biogum composition is subjected to jet-cooking in the presence of a thermally stable alpha amylase with the effect that the starch is slightly thinned during its passage through the jet cooker cooking step. The jet-cooked starch and biogum composition can be recycled and subjected to multiple passes through a jet cooker and/or can be subjected to multiple jet cooking devices as well as other batch cookers. Heat and shear treatment can be applied to the starch/biogum composition using other devices such as high shear mixers, homogenizers and "Galin" homogenizers both in the presence or absence of enzyme or acid thinning environments. While the enzyme and acid treatment is believed to account for a substantial portion of the thinning effects it is believed that the shearing and high temperature conditions further act to thin the starch portion of the composition by acting on the crystalline structure of the starch by reducing entanglement of the starch molecules.

According to one aspect of the invention is provided a stable aqueous carbohydrate composition comprising depolymerized starch and a biogum produced according the method comprising the step of subjecting an aqueous starch and biogum composition to heat and shearing sufficient to hydrate and disperse the starch and biogum molecules to produce a viscosity stable, high solids, pumpable/flowable dispersion.

For the purposes of the products of the present invention, viscosity stable materials have a shelf life (time before a significant increase in viscosity) of at least one week. A significant increase in viscosity is more than a 20% increase in Brookfield viscosity (as measured on a Brookfield RVT at 75° F., #5 spindle, and 10 rpm). Preferred viscosity stable materials of the present invention are viscosity stable for at least one month and most preferred viscosity stable materials of the present invention are viscosity stable for at least 3 months.

High solids materials of the present invention have a solids level of at least 15% dry substance (ds) basis (as measured on a Mettler Toledo HR73 Halogen Moisture Analyzer at 150° C.). Preferred high solids materials of the present invention have a solids level of at least 20% (ds) basis and more preferred materials of the present invention have a solids level of at least 30% (ds) basis; and 40% (ds) basis. Particularly preferred high solids materials of the invention are those with solids levels of 50% (ds) basis; and 60% and greater (ds) basis.

Pumpable/flowable materials of the present invention are those materials that may be readily pumped from a 250 or 330 gallon tote at a reasonable pumping rate with normal methods available at the average paper mill. While it is recognized that virtually any viscosity material can be handled and pumped with the proper specialized equipment the compositions of the invention are those having a Brookfield viscosity less than or equal to 20,000 cPs (Brookfield viscosity as measured on a Brookfield RVT at 75° F., #5 spindle, 10 rpm). It is also recognized that biogums frequently form gel-like structures. It is important therefore, that a flowable material for the purposes of the present invention means that regardless of the viscosity or gel-like structure, the material in the tote or tank must be able to be pumped without prior mixing (up to the shelf-life of the material). Although it has been determined through practical experience that a preferred pumpable/flowable material of the present invention would have a Brookfield viscosity of less than 12,000 cP the most preferred materials of the present invention have a Brookfield viscosity of less than 10,000 cP. Nevertheless, it should be understood that the materials of the present invention can be made at virtually any combination of solids and viscosity and the choice of solids and viscosity is determined by the customer and equipment available to handle the product.

Biogums useful for practice of the present invention include all manner of natural and synthetic polysaccharide gums including but not limited to those selected from the group consisting of gellan, xanthan gum, locust bean gum, carrageenan, guar, alginate, carboxymethylcellulose, hydroxyethylcellulose, hemicellulose, gum Arabic and agar. Particularly preferred gums for use according to the invention for combination with starches are gellan gum and alginate but it is contemplated that other gums and combinations of gums such as gellan or alginate together or in combination and at least one other biogum such as xanthan gum will provide useful results according to practice of the invention.

Starches useful for practice of the invention include all manner of native starches and starch derivatives including but not limited to starches selected from the group consisting of dent and waxy corn starch, potato, rice tapioca, pea, and sorghum with waxy corn starch being particularly preferred for producing products for use as wet-end paper additives. Particularly useful are starch derivatives including those selected from the group consisting of cationic starches, anionic starches, amphoteric starches, etherified starches, acetylated starches and sulfonated starches. Particularly preferred derivatized starches include cationic waxy corn starch and anionic waxy corn starch such as an octenyl succinic anhydride (OSA) derivatized waxy corn starch.

The starches of the invention need not be but are preferably at least slightly depolymerized by acid or more preferably enzyme thinning. Such depolymerization optionally takes place during the heating and shearing process such as by the introduction of thermostable alpha-amylases during the heating and shearing process such as when thermostable alpha-amylases are introduced into a jet cooker used to subject the starch/gum composition to heating and shearing. In addition, the starch can be at least partly depolymerized prior to and/or after the heating and shearing processing step. According to one preferred aspect of the invention the depolymerized starch can be produced by acid hydrolysis of the starch in the granular state prior to the heating and shearing process.

Preferred enzymes for depolymerization of the starch include alpha-amylases but it is contemplated that other amylases and other enzymes such as transglycosylases will prove useful in practice of the invention.

According to other aspects of the invention the starch can be made by oxidation of the starch in the granular state prior to the heating and shearing process. Further, the starch can be a pregelled starch prior to being subjected to heating and shearing.

The compositions of the invention are highly stable and are particularly useful for use in wet-end paper making additives. According to one aspect of the invention the starch subjected to heating and shearing in the presence of gum is a first cationic starch which resulting composition can further be combined with a second cationic starch, such as a high charge, liquid cationic starch. High charge cationic starches useful as components of wet-end papermaking additives are well known to those of ordinary skill in the art but include liquid starches available commercially as liquid starch is Topcat® L98 cationic additive and Topcat® L95 cationic additive (Penford Products Co., Cedar Rapids, Iowa).

The compositions of the invention can also be combined with low charge liquid cationic starches such as those known to those of skill in the art as Penbond® cationic additive and PAF 9137 BR cationic additive (Penford Products Co., Cedar Rapids, Iowa).

According to another aspect of the invention the wet-end paper making additive can be that where the starch subjected to heating and shearing is a first anionic starch and the composition further comprises an anionic resin. Suitable anionic resins are known to those of ordinary skill in the art but include those such as polyacrylic acid, polyacrylamide copolymer. While those of ordinary skill in the art would be familiar with various polyacrylamides copolymers useful for practice with the invention one particularly preferred polyacrylamide copolymer is Hexafloc DS-230 (Hexagon Technologies, Inc., Louisville, Ky.).

According to one aspect of the invention the wet-end paper making additive further comprises an uncooked starch including those selected from the group consisting of dent and waxy corn, potato, rice, tapioca, pea, sorghum and similar starches but wherein unmodified dent corn starch is particularly preferred. The uncooked starch can also be a charged starch such as a cationic starch such as those selected from the group consisting of dent and waxy corn, potato, rice, tapioca, pea, sorghum and similar cationic starch materials with a particularly preferred cationic dent corn starch being Pencat® 700 cationic starch (Penford Products Co., Cedar Rapids, Iowa).

The wet-end paper making additives of the invention can further comprise fillers such as inorganic fillers selected from the group consisting of calcium carbonate, clay, titanium dioxide, talc, silica, alumina and similar materials.

As detailed above, the biogum or biogum mixtures are added to a slurry of uncooked starch and water and this mixture is heated with shear to cook out the starch granules and to disperse the starch molecules with the biogum(s). This cooked and dispersed biogum and starch mixture is then used as is or combined with another liquid starch and/or anionic (or cationic) resin. This cooked liquid starch/biogum/additional liquid starch and/or resin mixture may be also then be used as is or it can be further blended with an uncooked starch and/or an inorganic material such as precipitated calcium carbonate, colloidal silica, clay, gypsum, talc, or the like.

For the purposes of determining the concentration of the biogum in the compositions of the products of the current invention, the concentration of the biogum (or biogum mixtures) based on the dry substance of the liquid portion of these blends and excluding any added uncooked starch or inorganic materials will be used. Therefore, for the purposes this invention, the range of biogum (or biogum mixture) concentration relative to the liquid starch (or starch plus resin) is generally from 0.1 to 4.0% of as is biogum to dry substance starch (or starch plus resin) but more preferably from 0.1 to 2.5%. A more preferred concentration of biogum to liquid starch is 0.5 to 2.0% and an especially preferred concentration is 1.0 to 1.5%.

The starch biogum compositions of the invention including some or all of the additives listed above (with the general exception of anionic starches because paper additives usually comprise non-ionic or cationic starches) as wet-end additives can also be used as paper additives for application between the plies of a multi-ply board on a paperboard machine.

The products can also be used in the manufacture of other forest products with organic substrates and in combination with inorganic substrates such as for the manufacture of products such as gypsum board and roofing tiles.

The products of the invention can also be in applications such as water treatment for example in the manufacture of flocculants and as "muds" for oil drilling and as proppants and hydraulic fracturing fluids. It is believed that starch biogum combinations of the invention using biogums other than guar such as gellan can be substituted for the guar component of proppants and fracturing fluids including slickwater fracturing fluids comprising ingredients of water, hydrochloric acid, polymeric friction reducers, biocides and emulsifiers.

DETAILED DESCRIPTION OF THE INVENTION

Figure 1:
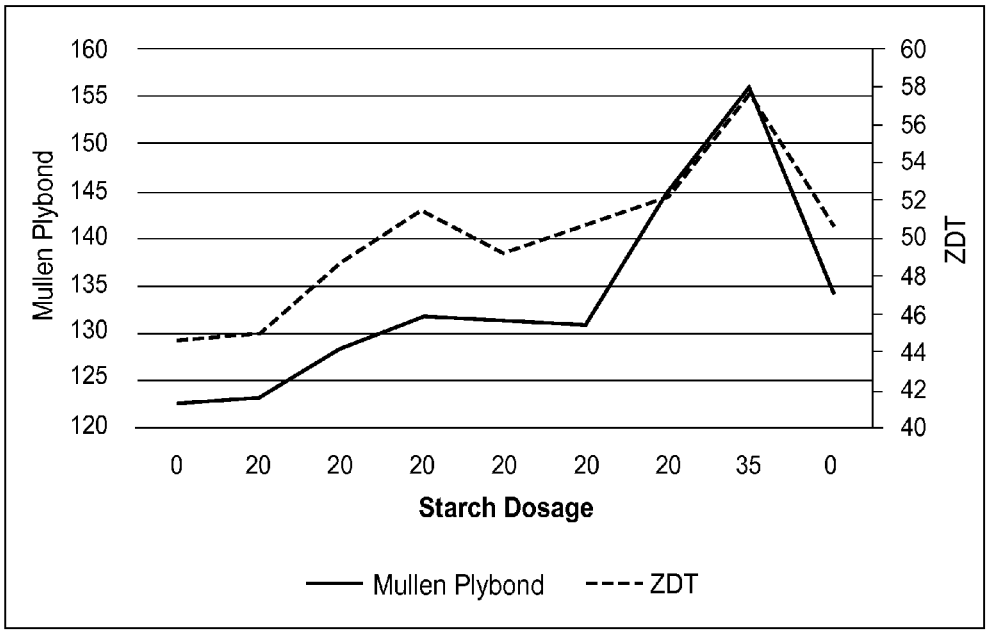
FIG. 1 depicts the strength properties of paperboard according to the invention.

The present invention relates to the discovery that starch treated in the presence of a biogum by the application of heat and shear is characterized by various improved properties compared with starch and biogum alone or compared with starch treated by the application of heat or shear alone. According to a particularly preferred aspect of the invention the starch/biogum compositions is depolymerized such as by using acid, enzyme or oxidative thinning. Without intending to be bound by any particular theory of invention it is believed that treatment of the starch component by heat and shear and enzyme or acid thinning might act to thin the starch enzymatically by cleaving amylose and amylopectin chains within the starch while the heating and shearing aspects of the treatment might break up the entangled structure of the starch molecules. While it is not known whether the biogum is enzymatically thinned by treatment with the alpha amylase it is believed that the presence of the biogum during the combination of enzymatic thinning and shearing and heating stabilizes the starch.

According to one aspect of the invention is provided a wet-end pulp and paper additive made from a combination of cooked and uncooked starch and a biogum such as gellan gum as the suspending agent for the uncooked starch. The cooked starch portion can be a combination of a low charge cationic starch and a high charge cationic starch. Similarly, an anionic cooked starch can be provided in an analogous manner. Without intending to be bound by any particular theory of invention it is believed that the biogum may act as a suspending agent for the granular starch while improving properties of the final paperboard.

The compositions provided herein provide a means of adding more starch to the wet-end of a paper making process thereby increasing strength while at the same time avoiding negative performance attributes such as foaming during the sheet formation. The suspension of the uncooked (granular) starch provides an additional benefit as this starch can then be "cooked" during the drying process of paper manufacture thereby providing additional strength in the formed sheet. The resulting paper is characterized by improved strength and stiffness relative to paper manufactured in an equivalent manner with conventionally treated starch.

When the products are used in commercial paperboard manufacturing the resulting products are characterized by improved plybond, stiffness and ring crush and further permit dramatic increases in machine speed.

According to one aspect of the invention a new wet-end pulp and paper additive made from a combination of cooked and uncooked starch and a biogum such as gellan gum as the suspending agent for the uncooked starch. The cooked starch portion may be a combination of a low charge cationic starch and a high charge cationic starch. Similarly, anionic cooked starches can be used in an analogous manner. The compositions described herein provide a means of adding more starch to the wet-end thereby increasing strength while at the same time avoiding negative performance attributes (such as foaming) during the sheet formation. The suspension of the uncooked (granular) starch provides an additional benefit as this starch can be "cooked" during the drying process thereby providing additional strength in the formed sheet.

As will be readily appreciated by those of skill in the art the gelatinization temperature of the granular portion can be tuned. For example, potato granules will cook out at a lower temperature than waxy or dent granules. Accordingly, starches can be selected according to their gelatinization characteristics which vary by plant species as well as by derivitization, crosslinking and the like. Such selection can provide advantages in the dryer section such as lower energy requirements, faster speeds and the like.

Similarly, according to one aspect of the invention extruded, crosslinked starch latex particles including those sold commercially as EcoSynthetix starches and described in Giezen, et al., U.S. Pat. No. 6,677,386 and Von Soest, et al., U.S. Pat. No. 6,755,915 can be incorporated into the compositions of the invention.

Example 1

Wet-End Experiment

According to this example, a wet-end additive for papermaking was produced in accordance with the invention. Specifically, about 35 lbs. of gellan gum (Kelcogel® LT 100, CP Kelco) was added slowly with agitation to about 720 gallons of water in a 1500 gallon stirred vessel with good agitation. To this stirring mixture of gellan and water was added about 1760 lbs (dry solids (ds) basis) of cationic waxy corn starch (with a nitrogen content of about 0.032%). The total solids of this mixture before cooking was about 22.0% (ds basis) and the pH was about 6.12.

This mixture was then cooked and enzyme thinned with about 10 ppm alpha amylase (Spezyme® Fred, Genencor a division of Danisco USA) through a conventional double jet cooking system, with the first jet cooker set at about 222° F. and the second jet cooker set at about 300° F. The resulting product had a viscosity of about 176 cP as measured on a Rapid Visco Analyzer (Newport Scientific, Warriewood NSW, Australia) at 7.23% solids, 20° C. and 600 rpm. The final solids of the cooked paste (after water of dilution during the cook) was about 20.6%.

About 3840 lbs of the cooked and thinned cationic waxy corn starch/gellan mixture was pumped into a stirred mix tank. To this stirring mixture was added about 1080 lbs of Topcat®L98 cationic additive (Penford Products Co., Cedar Rapids, Iowa) at about 34.7% solids which was equivalent to about 375 lbs (ds basis) of the cationic additive. About 1125 lbs (ds basis) of uncooked, unmodified native dent corn starch was then added (under good agitation) to the cationic waxy corn starch/gellan and Topcat L98 mix with good agitation at a temperature of from room temperature to about 110° F. About 202 lbs of water was also added to bring the final solids of the mix down to about 36.30% (ds basis). The final viscosity (as measured on a Brookfield RVT viscometer with #5 spindle at 10 rpm and 75° F.) was 8500 cPs and the final pH was about 5.0. About 1.5 liters of preservative (BIOMATE SAN9361, GE Betz) was added to the final mixture. The calculated final total nitrogen based on total solids of the mixture was about 0.37% (ds basis).

Example 2

Plyboard Additive Experiment

According to this example, a trial was conducted on a commercial multi-ply cylinder paperboard paper machine using commercially prepared recycle paperboard pulp. The objective of the trial was to run a heavier weight board using the same fiber mix as that used to run a lighter weight board. Normally the mill is unable to run heavier weight board with the same fiber mix as a lighter weight board because this fiber mix does not have enough strength to maintain Z direction tensile bond (ZDT). Higher starch dosages have previously been applied to increase strength, but the higher starch dosages of competitive materials either do not provide the additional strength needed or cause machine run-ability problems such as foaming. Accordingly, the mill changes the fiber mix to a stronger fiber blend in order to run the higher weight grades. According to this example, the products of the current invention provide sufficient additional strength to the board that the mill is able to use the lower strength fiber blend and still maintain desired ZDT bond strength. Additional goals for this trial were to determine the effect of this new material on drainage of the board (removal of water from the sheet prior to entering the dryer section of the paper machine). As more water is removed in the wet-end of the paper machine, less steam is needed in the drier section to dry the sheet. If the machine is steam limited, lower steam demand allows the machine to run faster.

The paper board machine was running at a production rate of about 14.2 tons/hr. producing a lighter weight board. Prior to the start of the trial, a commercial high charge cationic starch product (Topcat® L98 cationic additive, Penford Products Co.) was being added to the paperboard machine at a rate of 4 dry lbs/ton (0.28 gallons per minute of the commercial Topcat L98 additive at 35% solids with about 8 gallons/minute dilution water) to the stuff box for the filler plies at the wet-end of the paperboard machine. The machine was producing the lighter weight board and the ZDT average test values were approximately 54 psi.

At the start of the trial, the Topcat® L98 additive flow was stopped and the mixture from example 1 was started at the same 4 dry lbs/ton (0.28 gallons per minute at 35% solids with 8 gallons/minute dilution water) addition rate. At about 3.5 hours after the start of the trial the dosage of the starch mixture from Example 1 was increased to about 8 lbs/ton. At approximately 7 hrs after the start of the trial, the machine was producing the heavy weight board. The dosage of the starch mixture from Example 1 was maintained at 8 lbs/ton for about the first hour and forty minutes. The dosage was then reduced to 6 lbs/ton (while still producing the heavy weight grade) and was run at this dosage for the next 8 hours. The mill then changed to a lighter weight board and lowered the dosage to 4 lbs/ton and ran at this dosage for the remainder of the trial (approximately 3 more hours). The average ZDT test value for the heavy weight board produced while at 8 lbs/ton was about 51.3 psi. The average ZDT test value for the heavy weight board produced while at 6 lbs/ton was about 48.5 psi. Prior to the trials with the new products of this invention, the mill had been unable to produce the heavy weight board using the lower strength fiber while maintaining acceptable ZDT strength values.

The effect of the new materials of the present invention on machine speed and steam usage is easier to see by looking at how the 24 pt board ran during the trial. The paperboard machine was producing 20 pt board when the trial started. At about 45 minutes after the start of the trial the grade was changed to 24 pt board. The normal machine speed on 24 pt board was about 517 ft/min. Because of reduced steam usage they were able to start to speed up the machine. They reached a speed of 537 ft/min and steam usage was still below normal levels. At this point, they started to move to heavier weight board. After the heavy weight board run (at approximately 17 hours after the start of the trial) they went back to producing 24 pt board. The starch dosage was again down to 4 lbs/ton, but even at this level, they were able to speed the machine up to 548 ft/min while still using below normal levels of steam for drying. See Table 1 below for a summary of machine run conditions and paperboard test values for this trial.

TABLE 1

| Time min | Starch Example 1 lbs/ton | Caliper | Moisture % | ZDT PSI | MD Stiffness | CD Stiffness | Machine Speed ft/min | Steam Pressure PSI |
|---|---|---|---|---|---|---|---|---|
| 0 | 4 | 20.1 | 6.18 | 52 | | | 605 | 98 |
| 44 | 4 | 23.9 | 6.08 | | | | 517 | 92 |
| 62 | 4 | 24.1 | 6.1 | 45 | 439 | | 527 | 77 |
| 91 | 4 | 24.8 | 6.6 | 51 | 449 | | 531 | 86 |
| 114 | 4 | 24.4 | 6.5 | 49 | 463 | | 535 | 92 |
| 140 | 6 | 24.4 | 6.6 | 56 | | | 537 | 96 |
| 166 | 6 | 24.3 | 6.2 | 55 | 462 | 169 | 537 | 96 |
| 191 | 6 | 24.1 | 6.2 | 53 | | | 537 | 90 |
| 217 | 8 | 24.2 | 6.3 | 55 | | | 537 | 88 |
| 238 | 8 | 24.2 | 6.3 | 52 | 452 | | 537 | 90 |
| 300 | 8 | 26.2 | 6.2 | 51 | | | 488 | 75 |
| 326 | 8 | 26.4 | 6.2 | 50 | | | 488 | 73 |
| 352 | 8 | 26.2 | 6.5 | 52 | | | 488 | 74 |
| 375 | 8 | 26.4 | 6.4 | 55 | 550 | 221 | 488 | 72 |
| 419 | 8 | 27.4 | 6.2 | 48 | | | 477 | 74 |
| 445 | 8 | 27.7 | 6.6 | 53 | | | 479 | 80 |
| 470 | 8 | 27.9 | 6.4 | 51 | | | 479 | 84 |
| 520 | 8 | 28 | 6.3 | 53 | 610 | 230 | 479 | 83 |
| 545 | 6 | 28.1 | 6.2 | 52 | | | 479 | 84 |
| 570 | 6 | 27.9 | 6.2 | 48 | | | 477 | 82 |
| 595 | 6 | 27.9 | 6.1 | 52 | | | 477 | 79 |
| 621 | 6 | 28 | 6.2 | 48 | | | 469 | 76 |
| 646 | 6 | 28.1 | 6.2 | 48 | | | 469 | 75 |
| 672 | 6 | 28 | 6.2 | 46 | | | 469 | 74 |
| 698 | 6 | 28 | 6.2 | 49 | 625 | 227 | 469 | 75 |
| 723 | 6 | 28.1 | 6.2 | 47 | | | 469 | 77 |
| 749 | 6 | 28.2 | 6.3 | 48 | | | 469 | 75 |
| 774 | 6 | 28.2 | 6.3 | 48 | | | 469 | 76 |
| 800 | 6 | 28.2 | 6.3 | 46 | | | 469 | 76 |
| 825 | 6 | 28 | 6.3 | 49 | | | 469 | 75 |
| 851 | 6 | 27.9 | 6.3 | 49 | | | 469 | 71 |
| 877 | 6 | 27.8 | 6.3 | 48 | | | 469 | 68 |
| 900 | 6 | 27.7 | 6.3 | 49 | | | 469 | 67 |
| 928 | 4 | 26.4 | 5.7 | 51 | | | 496 | 81 |
| 953 | 4 | 26.4 | 5.5 | 48 | | | 496 | 82 |
| 977 | 4 | 26.4 | 5.4 | 49 | | | 496 | 83 |
| 1008 | 4 | 24.1 | 5.5 | 47 | 481 | 171 | 533 | 86 |
| 1033 | 4 | 23.9 | 6 | 50 | | | 545 | 88 |
| 1058 | 4 | 23.8 | 6 | 51 | | | 548 | 89 |
| 1084 | 4 | 23.8 | 6.4 | 50 | | | 548 | 89 |
| 1109 | 4 | 24.2 | 6.3 | 53 | 461 | 161 | 548 | 101 |

Example 3

Plyboard Additive Experiment

According to this example another trial was run on the commercial multi-ply cylinder paperboard paper machine of Example 2. The objective of this trial was also to run a heavier weight board using the same fiber mix as that used to run a lighter weight board. An additional goal of this trial was to see if a lower dosage of the products of this invention could be run and still maintain properties of the board (particularly ZDT). A normal wet-end starch dosage is 4 lbs/ton on the lighter weight grades. The goal was to get down to at least 2.5 lbs/ton of the new materials of the present invention and still maintain the same strength properties and machine speeds.

The paper board machine was running at a rate of about 14.2 tons/hr. producing a lighter weight board. As in example 2, prior to the start of the trial, a commercial high charge cationic starch product (Topcat® L98 cationic additive, Penford Products Co.) was being added to the paperboard machine at a rate of 4 dry lbs/ton (0.28 gallons per minute of the commercial Topcat® L98 at 35% solids with 8 gallons/minute dilution water) to the stuff box for the filler plies at the wet-end of the paperboard machine At the start of the trial, the Topcat® L98 flow was stopped and the mixture from example 1 was started at the same 4 dry lbs/ton (0.28 gallons per minutes at 35% solids with about 8 gallons/minute dilution water) addition rate. At about 2.5 hours after the start of the trial the dosage of the starch mixture from example 1 was increased to about 6 lbs/ton. At approximately 3 hrs after the start of the trial, the starch dosage was increased to about 8 lbs/ton. At just over 6 hours, the machine started producing the heavy weight board. The dosage of the starch mixture from example 1 was at 8 lbs/ton for most of the heavy weight run. At the end of the heavy weight run (about the last hour) the dosage was reduced to about 4 lbs/ton to see the effects of the lower dosage on ZDT. The ZDT did drop but was still well within the limits for this grade. The grade changed to a lighter weight board and the trial continued at 41 bs/ton for approximately 10 more hours. The dosage was then lowered to 3 lbs/ton and then down to 2.5 lbs/ton. At about 22.5 hours after the start of the trial, the starch mixture from example 1 was turned off and the mill went back to using Topcat L98 at a dosage rate of 4 lbs/ton.

The average ZDT test value for the heavy weight board produced during this trial while at 8 lbs/ton was 56.3 psi. The ZDT went down to about 52 psi at 4 lbs/ton which is well above the lower control limit of 44.9 psi. Prior to the trials with the new products of this invention, the mill had been unable to produce the heavy weight board using the lower strength fiber while maintaining acceptable ZDT strength values and machine speeds.

The average ZDT value at 4 lbs/ton running the lighter weight board (24 pt) was 53.5 psi. The average ZDT value at 2.5 lbs/ton running 24 pt was 53.7, showing that even at lower dosages than normally used to produce these products, strength properties and machine speeds are maintained. See Table 2 below for a summary of machine run conditions and paperboard test values for this trial.

TABLE 2

| Time min | Starch Example 1 lbs/ton | Caliper | Moisture % | ZDT PSI | Machine Speed ft/min |
|---|---|---|---|---|---|
| 0 | 0 | 24.5 | 6.1 | 54 | 516 |
| 26 | 4 | 24.3 | 6.1 | 53 | 517 |
| 53 | 4 | 24.7 | 6.2 | 53 | 519 |
| 78 | 4 | 24.2 | 6.1 | 53 | 519 |
| 121 | 4 | | 5.8 | | 485 |
| 148 | 4 | 26.1 | 5.9 | 53 | 485 |
| 174 | 6 | | | 51 | |
| 200 | 8 | | | 50 | |
| 280 | 8 | 26.2 | 6 | 52 | 479 |
| 307 | 8 | 26.1 | 6 | 53 | 479 |
| 331 | 8 | 26.2 | 5.8 | | 477 |
| 361 | 8 | 28.3 | 5.6 | 54 | 444 |
| 388 | 8 | 27.6 | 5.6 | 54 | 443 |
| 421 | 8 | 27.3 | 5.9 | 60 | 443 |
| 443 | 8 | 27.9 | 5.9 | 58 | 443 |
| 467 | 8 | 27.9 | 5.9 | 57 | 443 |
| 496 | 8 | 27.9 | 5.8 | 55 | 443 |
| 523 | 8 | 27.7 | 5.9 | 56 | 443 |
| 549 | 4 | 27.6 | 5.9 | 52 | 443 |
| 572 | 4 | | 5.9 | 52 | 443 |
| 609 | 4 | | 5.4 | 56 | 521 |
| 661 | 4 | | 5.4 | 54 | 521 |
| 688 | 4 | | 6 | 56 | 521 |
| 715 | 4 | | 5.9 | 55 | 521 |
| 742 | 4 | 24.1 | 5.4 | 55 | 521 |
| 769 | 4 | 24 | 5.9 | 53 | 521 |
| 795 | 4 | 24.4 | 6 | 52 | 521 |
| 822 | 4 | 24.7 | 5.9 | 55 | 521 |
| 848 | 4 | 24.5 | 5.8 | 51 | 521 |
| 874 | 4 | 24.2 | 5.8 | 56 | 521 |
| 901 | 4 | 24.2 | 5.8 | 53 | 521 |
| 933 | 4 | 24.2 | 5.9 | 52 | 521 |
| 953 | 4 | 24.4 | 5.9 | 54 | 521 |

TABLE 2-continued

| Time min | Starch Example 1 lbs/ton | Caliper | Moisture % | ZDT PSI | Machine Speed ft/min |
|---|---|---|---|---|---|
| 979 | 4 | 24.5 | 5.9 | 51 | 521 |
| 1006 | 4 | 24.1 | 5.8 | 51 | 521 |
| 1032 | 4 | 24.7 | 5.8 | 47 | 521 |
| 1059 | 4 | 24.5 | 5.8 | 51 | 521 |
| 1085 | 4 | 24.2 | 5.8 | 51 | 521 |
| 1112 | 4 | 24.2 | 5.7 | 51 | 521 |
| 1138 | 4 | 24.2 | 5.9 | 54 | 521 |
| 1165 | 4 | 24.1 | 5.9 | 58 | 521 |
| 1193 | 4 | 24.1 | 5.4 | 58 | 521 |
| 1220 | 4 | 23.9 | 5.9 | 57 | 521 |
| 1246 | 3 | 24 | 5.9 | 57 | 521 |
| 1273 | 2.5 | 24.1 | 5.8 | 54 | 521 |
| 1299 | 2.5 | 24.1 | 5.8 | 55 | 521 |
| 1326 | 2.5 | 24.1 | 5.8 | 52 | 521 |
| 1352 | 0 | 24.1 | 5.7 | 54 | 521 |
| 1379 | 0 | 24.1 | 5.8 | 51 | 521 |
| 1405 | 0 | 23.9 | 5.8 | 55 | 521 |
| 1438 | 0 | 24.2 | 5.8 | 58 | 520 |

Example 4

Plyboard Additive Experiment

According to this example a trial was run on a commercial multi-ply Fourdrinier paperboard paper machine at a different mill than the trials run in examples 2 and 3. The objective of this trial was to improve the strength properties of the board, particularly plybond (ZDT) and Mullen. These improved strength properties can be seen in FIG. 1.

The paper board machine was running at a rate of about 10.5 tons/hr. producing a 28 pt. board. The mill was not adding any other starch product directly prior to this trial. At the start of the trial, the mixture from example 1 was started at about 20 dry lbs/ton (1.0 gallons per minute at 35% solids with about 10 gallons/minute dilution water) addition rate. The mixture from example 1 was added to the blend chest which is an earlier addition point in the stock preparation area when compared to the addition points in the previous examples. This meant that there would be a longer time interval before results would be seen on finished board. At about 12 hours after the start of the trial the dosage of the starch mixture from example 1 was increased to about 35 lbs/ton. The dosage was maintained at 35 lbs/ton for the remainder of the trial (the trial lasted for a total of about 14.5 hours).

Table 3 lists the test values for the trial. Pretrial data in Table 3 below is the average of test sheets from two reels of board run just before starch was added. Trial data in Table 3 at 20 lbs/ton is the average of test sheets from the last 5 reels of board run at the 20 lbs/ton starch dosage. Trial data in Table 3 at 35 lbs/ton is the average of test sheets from 2 reels of board run at the 35 lbs/ton starch dosage. Table 3 and FIG. 1 also show the dramatic drop in strength properties when the starch dosage is stopped.

TABLE 3

| Time min | Starch Example 1 lbs/ton | Caliper | Mullen Burst PSI | Mullen Plybond | ZDT | Machine Speed ft/min |
|---|---|---|---|---|---|---|
| 0 | 0 | 28 | 102.7 | 122.5 | 44.6 | 400 |
| 60 | 20 | 28 | 105 | 123.3 | 45 | 400 |
| 180 | 20 | 28 | 107.5 | 128.3 | 48.7 | 400 |
| 300 | 20 | 28 | 101.2 | 131.7 | 51.5 | 400 |
| 420 | 20 | 28 | 102.3 | 131.2 | 49.2 | 400 |

TABLE 3-continued

| Time min | Starch Example 1 lbs/ton | Caliper | Mullen Burst PSI | Mullen Plybond | ZDT | Machine Speed ft/min |
|---|---|---|---|---|---|---|
| 540 | 20 | 28 | 105.7 | 130.8 | 50.7 | 400 |
| 660 | 20 | 28 | 116.2 | 145 | 52.2 | 400 |
| 840 | 35 | 28 | 117.2 | 155.8 | 57.7 | 400 |
| 900 | 0 | 28 | 105.2 | 134.2 | 50.6 | 400 |

Example 5

Plyboard Additive Experiment

According to this example, a trial was run on a commercial multi-ply cylinder paperboard paper machine at a different mill than the trials run in examples 2, 3 and 4. The objective of this trial was to improve the strength properties of the board, particularly ring crush but also Scott Plybond and Mullen. These improved strength properties can be seen in FIG. 2.

The paper board machine was running at a rate of about 12.4 tons/hr. producing a 35# liner board. At the start of the trial, the mixture from example 1 was started at about 10 dry lbs/ton (0.61 gallons per minute at 35% solids with about 8 gallons/minute dilution water) addition rate. At just over 2 hours after the start of the trial the dosage of the starch mixture from example 1 was increased to about 15 lbs/ton. At approximately 4 hrs after the start of the trial, the starch dosage was increased to about 20 lbs/ton. The dosage was maintained at 20 lbs/ton for the remainder of the trial (the trial lasted for a total of about 6 hours).

This trial demonstrated that while the products of the present invention show dramatic increases in strength properties, increasing the dosage beyond a certain level may not show additional increases in strength properties. The dosage level to reach the optimum strength properties is dependent on the type of machine, the type of fiber and the grade of paper or board being produced.

Figure 2:
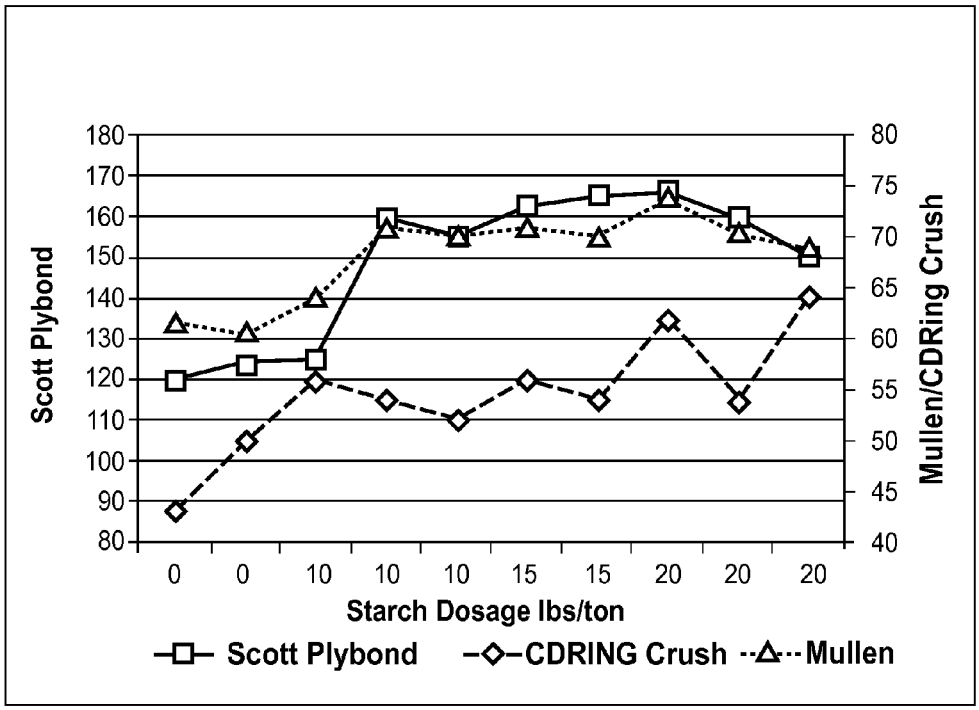
FIG. 2 depicts the strength properties of board produced according to the invention.

See Table 4 and FIG. 2 for a summary of machine run conditions and paperboard test values for this trial. The data at 0 lbs/ton in Table 4 and FIG. 2 is the average of the 3 reels of board run before starch was added.

TABLE 4

| Time min | Starch Example 1 lbs/ton | Caliper | Mullen PSI | CD Ring Crush | Scott Plybond | MD Stiffness | CD Stiffness | Machine Speed ft/min |
|---|---|---|---|---|---|---|---|---|
| 0 | 0 | 10.275 | 61.5 | 43 | 120 | 56 | 26 | 1030 |
| 102 | 10 | 10.6 | 64 | 50 | 125 | 53 | 27 | 1030 |
| 153 | 10 | 9.95 | 71 | 56 | 160 | 51 | 27 | 1000 |
| 188 | 10 | 10.25 | 70 | 54 | 155 | 60 | 31 | 1000 |
| 239 | 15 | 10.15 | 71 | 52 | 163 | 66 | 30 | 1000 |
| 289 | 15 | 10.375 | 70 | 56 | 165 | 64 | 24 | 1000 |
| 338 | 20 | 10.35 | 74 | 54 | 166 | 69 | 24 | 1000 |
| 394 | 20 | 10.05 | 70.5 | 62 | 160 | 60 | 20 | 1000 |
| 437 | 20 | 10.2 | 69 | 54 | 150 | 56 | 26 | 1000 |

Example 6

Plyboard Additive Experiment

Figure 3:
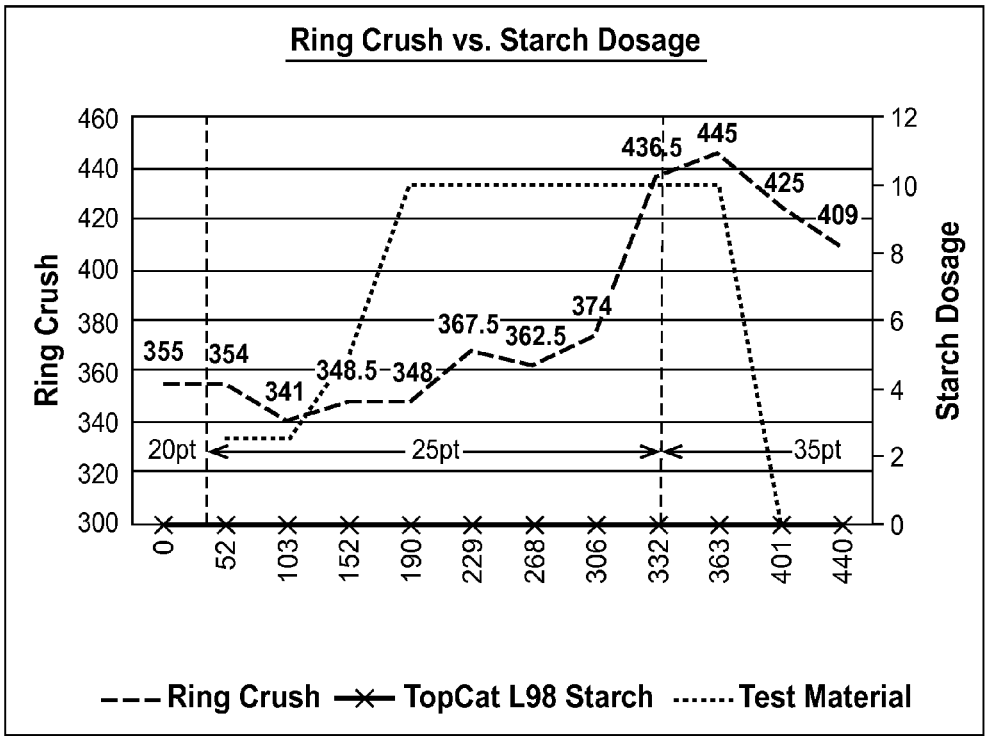
FIG. 3 depicts the strength properties of board produced according to the invention.

According to this example, a trial was run on a commercial multi-ply paperboard paper machine at a different mill than the trials run in examples 2, 3, 4 and 5. The objective of this trial was to improve the strength properties of the board, particularly ring crush and Mullen plybond. These improved strength properties can be seen in FIG. 3.

The paper board machine was running at a rate of about 6.8 tons/hr. producing a 25 pt. board. As in example 2, prior to the start of the trial, a commercial high charge cationic starch product (Topcat® L98 cationic additive, Penford Products Co.) was being added to the paperboard machine at a rate of 2 dry lbs/ton (0.07 gallons per minute of the commercial Topcat L98 at 35% solids with 4 gallons/minute recycled white water as the dilution water). Approximately 1 hour before the start of the trial, the Topcat L98 flow was stopped. After this one hour period without starch, the mixture from example 1 was started at about 2.5 dry lbs/ton (0.088 gallons per minute at 35% solids with about 4 gallons/minute dilution water) addition rate. The mixture from example 1 was added to the top of the machine chest which is still an early addition point relative to examples 2-4. Again, this means that there is a longer time interval (about 45 minutes) before results would be seen on finished board (but not as long an interval as example 5 since the machine chest is closer to the machine than the blend chest). At about 2 hours and 32 minutes after the start of the trial the dosage of the starch mixture from example 1 was increased to about 5 lbs/ton. At about 3 hours and 10 minutes after the start of the trial the dosage was increased to about 10 lbs/ton. The mill increased caliper at about 5 hours and 32 minutes after the start of the trial to a 36 pt board.

See Table 5 for a summary of machine run conditions and board test values for this trial. Table 5 and FIG. 3 also show a dramatic drop in ring crush when the starch dosage is stopped.

TABLE 5

| Time min | Starch Example 1 lbs/ton | Caliper | Mullen PSI | Ring Crush | Machine Speed ft/min | Steam Pressure PSI |
|---|---|---|---|---|---|---|
| 0 | 0 | 25.6 | 198 | 355 | 389 | 80 |
| 52 | 2.5 | 25.5 | 212 | 354 | 389 | 75 |
| 103 | 2.5 | 24.9 | 190 | 341 | 388 | 70 |
| 152 | 5 | 25.1 | 186 | 348.5 | 388 | 70 |
| 190 | 10 | 24.9 | 206 | 348 | 388 | 70 |
| 229 | 10 | 25.1 | 200 | 367.5 | 388 | 70 |
| 268 | 10 | 25 | 215 | 362.5 | 389 | 70 |
| 306 | 10 | 25.2 | 220 | 374 | 389 | 70 |
| 332 | 10 | 36 | 194 | 436.5 | 389 | 90 |
| 363 | 10 | 36 | 194 | 445 | 389 | 90 |
| 401 | 0 | 36 | 196.7 | 425 | 389 | 90 |
| 440 | 0 | 36 | 192.7 | 409 | 389 | 90 |

Example 7

Wet-End Additive Experiment

According to this example, a wet-end additive for papermaking was produced in accordance with the invention. Specifically, about 35 lbs. of gellan was added slowly with agitation to about 720 gallons of water in a 1500 gallon stirred vessel. To this stirring mixture of gellan and water was added about 1760 lbs (ds basis) of cationic waxy corn starch (with a nitrogen content of about 0.032%). The total solids of this mixture before cooking were about 19.0% (ds basis) and the pH was about 6.12.

This mixture was then cooked through a conventional double jet cooking system, with the first jet cooker set at about 222° F. and the second jet cooker set at about 300° F. The final solids of the cooked paste (after water of dilution during the cook) were about 17.1%.

A series of lab blends were made using the above cooked (un-thinned) cationic starch with gellan. About 158.1 g of the cooked cationic waxy corn starch/gellan mixture (26.99 g dry substance basis) was blended with 151.02 g of Topcat® L98 cationic additive (53.97 g dry substance basis at 35.74% solids). The blend was mixed well with a lab mixer (marine prop) in a 500 ml plastic container. The temperature was adjusted to 75.0° F. The Brookfield viscosity was about 6880 cP.

A second blend was made with the cooked (un-thinned) cationic starch with gellan, Topcat® L98 cationic additive and uncooked pearl starch. About 195.25 g of the above cooked paste with gellan was blended with about 46.65 g of Topcat L98 cationic additive and about 56.82 g of dent pearl corn starch (50 g ds basis at 88% solids). The blend was mixed well with a lab mixer (marine prop) in a 500 ml plastic container. The calculated solids of this mixture were about 33.5%. A sample of the mixture was also run on the halogen moisture analyzer and the measured solids were about 33.9% (due to evaporation during mixing). The mixture was cooled to 75.0° F. The Brookfield viscosity was about 20,000 cP. The mixture was then diluted to about 30.0% solids and the temperature adjusted to 75.0° F. The Brookfield viscosity was about 10,400 cP at 30% solids (well within the range of a preferred pumpable/flowable material according to the definition of the products of the present invention). The calculated final total nitrogen based on total solids of the mixture was about 0.37% (ds basis).

Example 8

Wet-End Additive Experiment

According to this example, a wet-end additive for papermaking was produced in accordance with the invention. Specifically, about 35 lbs. of gellan was added slowly with agitation to about 720 gallons of water in a 1500 gallon stirred vessel. To this stirring mixture of gellan and water was added about 1760 lbs (ds basis) of octenyl succinic anhydride (OSA) waxy corn starch. The total solids of this mixture before cooking was about 22.5% (ds basis) and the pH was about 6.12.

This mixture was then cooked and enzyme thinned with about 10 ppm alpha amylase (Spezyme® Fred, Genencor a division of Danisco USA) through a conventional double jet cooking system, with the first jet cooker set at about 222° F. and the second jet cooker set at about 300° F. The final viscosity was about 173 cP as measured on a Rapid Visco Analyzer (Newport Scientific, Warriewood NSW, Australia) at 7.23% solids, 20° C. and 600 rpm. The final solids of the cooked paste (after water of dilution during the cook) was about 20.66%

A series of lab blends were made using the above cooked, thinned, OSA starch with gellan. About 290.42 g of the cooked OSA waxy with corn starch with gellan (60.0 g dry substance basis at 20.66% solids) was mixed with 89.94 g Hexafloc DS-230 (20.01 dry substance basis at 22.25% solids). The blend was mixed well with a lab mixer (cowl's blade) in a 500 ml plastic container. The temperature was adjusted to 75° F. The Brookfield viscosity was about 5120 cP.

A second blend was made with the cooked, thinned OSA waxy corn starch with gellan. About 242.01 g of the cooked OSA waxy corn starch/gellan mixture (50.00 g dry substance basis) was blended with 224.60 g of Hexafloc DS-230 from Hexagon Technologies, inc (49.97 g dry substance basis at 22.25% solids) and 113.60 g dent pearl corn starch (100 g dry basis at 88% solids). The blend was mixed well with a lab mixer (marine prop) in a 1000 ml plastic container. About 306.96 grams of the resultant blend was then diluted to 30.0% solids with 45.74 g tap water. The temperature was then adjusted to 75.0° F. The Brookfield viscosity was about 8480 cP.

Example 9

Wet-End Additive Experiment

According to this example, a series of blends were made between the cooked, thinned cationic corn starch with gellan (from example 1), cooked, thinned OSA corn starch (from example 8) and cationic additives such as Topcat® L98 or Penbond® cationic additives.

In one blend, about 182.23 g Penbond® cationic additive (66.00 g dry substance basis at 36.02% solids) was blended with 159.73 g of cooked and thinned OSA corn starch with gellan (33.00 g dry substance basis at 20.66% solids) and mixed well with a lab mixer (marine prop) in a 500 ml plastic container. The temperature was then adjusted to 75.0° F. The Brookfield viscosity was about 8640 cP. The final solids were 28.87%

In a second blend, about 159.72 g cooked, thinned OSA corn starch with gellan (33 g dry substance basis at 20.66% solids) was blended with 137.42 g Penbond® cationic additive (49.5 g dry substance basis at 36.02% solids) and 47.55 g Topcat L98 cationic additive (16.5 g dry substance basis at 34.70% dry solids) and mixed well with a lab mixer (marine prop) in a 500 ml plastic container. The temperature was then adjusted to 75.0° F. The Brookfield viscosity was about 7840 cP. The final solids were 28.72%.

Example 10

Wet-End Additive Experiment

According to this example, a blend was made using the cooked (unthinned) cationic corn starch with gellan (from example 7) with PenCook® 10 uncooked potato starch and Topcat® L98 cationic additive.

About 585.23 g of cooked (unthinned) cationic corn starch with gellan (100.07 dry substance basis at 17.1% solids) was blended with 140.49 g Topcat® L98 cationic additive (50.01 dry substance basis at 35.60% solids) and 181.27 g PenCook® 10 potato starch (150 dry substance basis at 33.60% solids) and mixed well with a lab mixer (marine prop) in a 1000 ml plastic container. The solids were then reduced to 30% using tap water. The blend was then adjusted to 75.0° F. The Brookfield viscosity was about 11,760 cPs.

Example 11

Wet-End Additive Experiment

According to this example, a wet-end additive for papermaking was produced in accordance with the invention. Specifically, about 35 lbs. of Xanthan gum (Keltrol®, CP Kelco) was added slowly with agitation to about 720 gallons of water in a 1500 gallon stirred vessel with good agitation. To this stirring mixture of xanthan and water was added about 1760 lbs (dry solids (ds) basis) of cationic waxy corn starch (with a nitrogen content of about 0.032%). The total solids of this mixture before cooking was about 23.5% (ds basis) and the pH was about 6.12.

This mixture was then cooked and enzyme thinned with about 10 ppm alpha amylase (Spezyme® Fred, Genencor a division of Danisco USA) through a conventional double jet cooking system, with the first jet cooker set at about 222° F. and the second jet cooker set at about 300° F. The resulting product had a viscosity of about 411 cP as measured on a Rapid Visco Analyzer (Newport Scientific, Warriewood NSW, Australia) at 7.23% solids, 20° C. and 600 rpm. The final solids of the cooked paste (after water of dilution during the cook) was about 20.7%.

A lab blend using this cooked and thinned cationic waxy corn starch with xanthan was then made. About 460.82 g of cooked and thinned cationic waxy corn starch with xanthan gum (100.00 g dry basis at 21.70% solids) was mixed with 144.51 g Topcat® L98 cationic additive (50.00 g dry basis at 34.60% solids) and then about 169.50 g of uncooked, unmodified native dent corn starch was added (150.06 g dry basis at 88.53%). The blend was then mixed well in a 1000 ml plastic container with a lab mixer (marine prop) for about 30 minutes and then diluted with tap water to reach 36.04% solids as measured on a halogen moisture analyzer. The temperature was then adjusted to 75° F. and the Brookfield viscosity of this blend was measured and found to be about 8800 cP.

Example 12

Wet-End Additive Experiment

According to this example, a blend was made using the cooked and thinned OSA waxy corn starch with gellan (from example 8) and colloidal silica.

About 435.62 g cooked and thinned OSA waxy corn starch with gellan (90.00 g dry basis at 20.66% solids) was mixed with about 61.69 g colloidal silica (10.00 g dry basis at 16.21% solids). The blend was mixed well in a 1000 mL plastic container with a lab mixer (marine prop) for 30 minutes after which the temperature was adjusted to 75° F. The solids, as measured on a halogen moisture analyzer were about 20.50% and the Brookfield viscosity was about 3,200 cP.

Example 13

Wet-End Additive Experiment

According to this example, a blend was made using Penbond® cationic additive, Topcat® L98 cationic additive, sodium alginate, and uncooked (unmodified) dry pearl starch granules.

In a 1000 mL plastic container, about 386.31 g of Penbond® cationic additive (149.93 g dry basis at 38.81% solids) was mixed with about 210.62 g of Topcat® L98 cationic additive (74.98 g dry basis at 35.60% solids) and then, while under agitation with a lab mixer (marine prop), 2.64 g of sodium alginate was slowly added over thirty minutes (2.25 g dry substance at 85.30% solids). After all the sodium alginate had been added, the blend was mixed for one hour.

After mixing, the solids of this Penbond®, Topcat L98® and sodium alginate blend were found to be 31.17% using a halogen moisture analyzer. About 240.62 g of this blend (75.00 g dry basis at 31.17% solids) was mixed with about 84.72 g uncooked, unmodified dry pearl starch (75.00 g dry basis at 88.53% solids). The solids were then reduced to 39.77%, as measured on a halogen moisture analyzer, and the temperature adjusted to 75° F. The Brookfield viscosity was measured and found to be 7080 cP.

Numerous modifications and variations in the practice of the invention are expected to occur to those skilled in the art upon consideration of the presently preferred embodiments thereof. Consequently, the only limitations which should be placed upon the scope of the invention are those which appear in the appended claims.

What is claimed:

1. A composition comprising a starch, a biogum and water subjected to heat and shearing sufficient to hydrate and disperse the starch and biogum molecules to produce a pumpable/flowable viscosity stable dispersion having a Brookfield viscosity of less than 20,000 cps (as measured on a Brookfield RVT at 75° F., #5 spindle, 10 rpm) and a starch and biogum solids level of at least 15% dry solids (ds) basis wherein the biogum is gellan.

2. The composition of claim 1 having a starch and biogum solids level of at least 20% (ds) basis.

3. The composition of claim 1 having a starch and biogum solids level of at least 30% (ds) basis.

4. The composition of claim 1 having a Brookfield viscosity of less than 12,000 cps (as measured on a Brookfield RVT at 75° F., #5 spindle, 10 rpm).

5. The composition of claim 1 having a Brookfield viscosity of less than 10,000 cps (as measured on a Brookfield RVT at 75° F., #5 spindle, 10 rpm).

6. The composition of claim 1 having a biogum content of from 0.1% to 2.5% of as is biogum to ds starch.

7. The composition of claim 1 wherein the starch is waxy corn starch.

8. A composition comprising a starch, a biogum and water subjected to heat and shearing sufficient to hydrate and disperse the starch and biogum molecules to produce a pumpable/flowable viscosity stable dispersion having a Brookfield viscosity of less than 20,000 cps (as measured on a Brookfield RVT at 75° F., #5 spindle, 10 rpm) and a starch and biogum solids level of at least 15% dry solids (ds) basis wherein the starch is depolymerized.

9. A wet-end paper making additive comprising a starch, a biogum and water subjected to heat and shearing sufficient to hydrate and disperse the starch and biogum molecules to produce a pumpable/flowable viscosity stable dispersion having a Brookfield viscosity of less than 20,000 cps (as measured on a Brookfield RVT at 75° F., #5 spindle, 10 rpm) and a starch and biogum solids level of at least 15% dry solids (ds) basis wherein the starch subjected to heating and shearing is a first cationic starch which composition is further combined with a second cationic starch.

10. A wet-end paper making additive according to claim 9 wherein the second cationic starch is a high charge, liquid cationic starch.

11. The wet-end paper making additive of claim 9 further comprising an uncooked starch.

12. The wet-end paper making additive of claim 11 wherein the uncooked starch is a modified starch.

13. The wet-end paper making additive of claim 12 wherein the modified starch is a cationic starch.

14. The wet-end paper making additive of claim 9 which further comprises a filler.

15. A method of manufacturing paper comprising adding the composition of claim 9 to the wet-end of a paper making machine.

16. The method of claim 15 wherein the composition is administered at a concentration of 0.5 to 40 lbs dry substance starch per ton of dry substance pulp fiber.

17. The composition of claim 8 having a starch and biogum solids level of at least 20% (ds) basis.

18. The composition of claim 8 having a starch and biogum solids level of at least 30% (ds) basis.

19. The composition of claim 8 having a Brookfield viscosity of less than 12,000 cps (as measured on a Brookfield RVT at 75° F., #5 spindle, 10 rpm).

20. The composition of claim 8 having a Brookfield viscosity of less than 10,000 cps (as measured on a Brookfield RVT at 75° F., #5 spindle, 10 rpm).

21. The composition of claim 8 wherein the biogum is selected from the group consisting of gellan, xanthan gum, locust bean gum, carrageenan, guar, alginate, carboxymethylcellulose, hydroxyethylcellulose, hemicellulose, gum Arabic and agar.

22. The composition of claim 8 having a biogum content of from 0.1% to 2.5% of as is biogum to ds starch.

23. The composition of claim 8 wherein the biogum is gellan.

24. The composition of claim 8 wherein the starch is waxy corn starch.

* * * * *